US005474397A

United States Patent [19]

Lyons

[11] Patent Number: 5,474,397

[45] Date of Patent: Dec. 12, 1995

[54] DRUM ACCESS MECHANISM

[75] Inventor: Scott F. Lyons, Shippensburg, Pa.

[73] Assignee: Ingersoll-Rand Company, Woodcliff Lake, N.J.

[21] Appl. No.: 251,805

[22] Filed: May 31, 1994

[51] Int. Cl.[6] ..... E01C 23/12

[52] U.S. Cl. ..... 299/39.5; 299/39.6

[58] Field of Search ..... 404/90, 91; 299/39, 299/89

[56] References Cited

U.S. PATENT DOCUMENTS

| | | | |
|---|---|---|---|
| 3,598,027 | 8/1971 | Swisher, Jr. | 404/90 X |
| 4,186,968 | 2/1980 | Barton | 404/90 X |
| 4,458,763 | 7/1984 | Rao et al. | 404/90 X |
| 4,637,753 | 1/1987 | Swisher, Jr. | 404/92 X |
| 4,647,248 | 3/1987 | Wirtgen . | |
| 4,797,025 | 1/1989 | Kennedy | 404/90 |

*Primary Examiner*—William P. Neuder
*Attorney, Agent, or Firm*—John J. Selko

[57] ABSTRACT

A mobile milling machine for milling a road surface includes a floating mold board for directing milled material onto a loading device positioned behind the machine. The mold board has fixed thereto a holder for the loading device. The loading device is pivotable side-to-side about a vertical axis, with respect to the holder. The mold board, the holder and the loading device are vertically movable a limited distance between a top and bottom stop position, and pivotable about a horizontal axis at the top stop position, to expose the milling roller for repairs. When the machine is in operation, the mold board, the holder and the loading device are hydraulically supported to permit the mold board to float along the milled surface in a grazing contact.

13 Claims, 6 Drawing Sheets

DRUM ACCESS MECHANISM

BACKGROUND OF THE INVENTION

This invention relates generally to mobile road milling machines, and more particularly to structures that support a loading device positioned behind the machine to collect milled material, while permitting easy access to the milling device for repairs.

SUMMARY OF THE INVENTION

In one aspect of the present invention, this is accomplished by providing a mobile milling machine for milling a road surface comprising: a chassis having a front portion and a rear portion; a milling roller rotatably mounted transversely on the chassis within a roller housing; a mold board mounted transversely on the chassis, rearwardly adjacent to the milling roller, in a substantially vertical position, for directing milled material therethrough; a loading device positioned rearward of the moldboard; a holder for the loading device fixed to the mold board; the mold board and the holder being vertically movable a limited distance between a top stop position and a bottom stop position and pivotable at the mold board upper edge about a substantially horizontal axis at the top stop position; means coupling the holder to the loading device, for pivoting the loading device with respect to the holder about a vertical axis; and actuator means for simultaneously raising the holder, the mold board and the loading device from the bottom stop position to the top stop position, and for thereafter simultaneously pivoting the holder, the mold board and the loading device about the horizontal axis, whereby the roller housing is opened to permit access to the milling roller.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
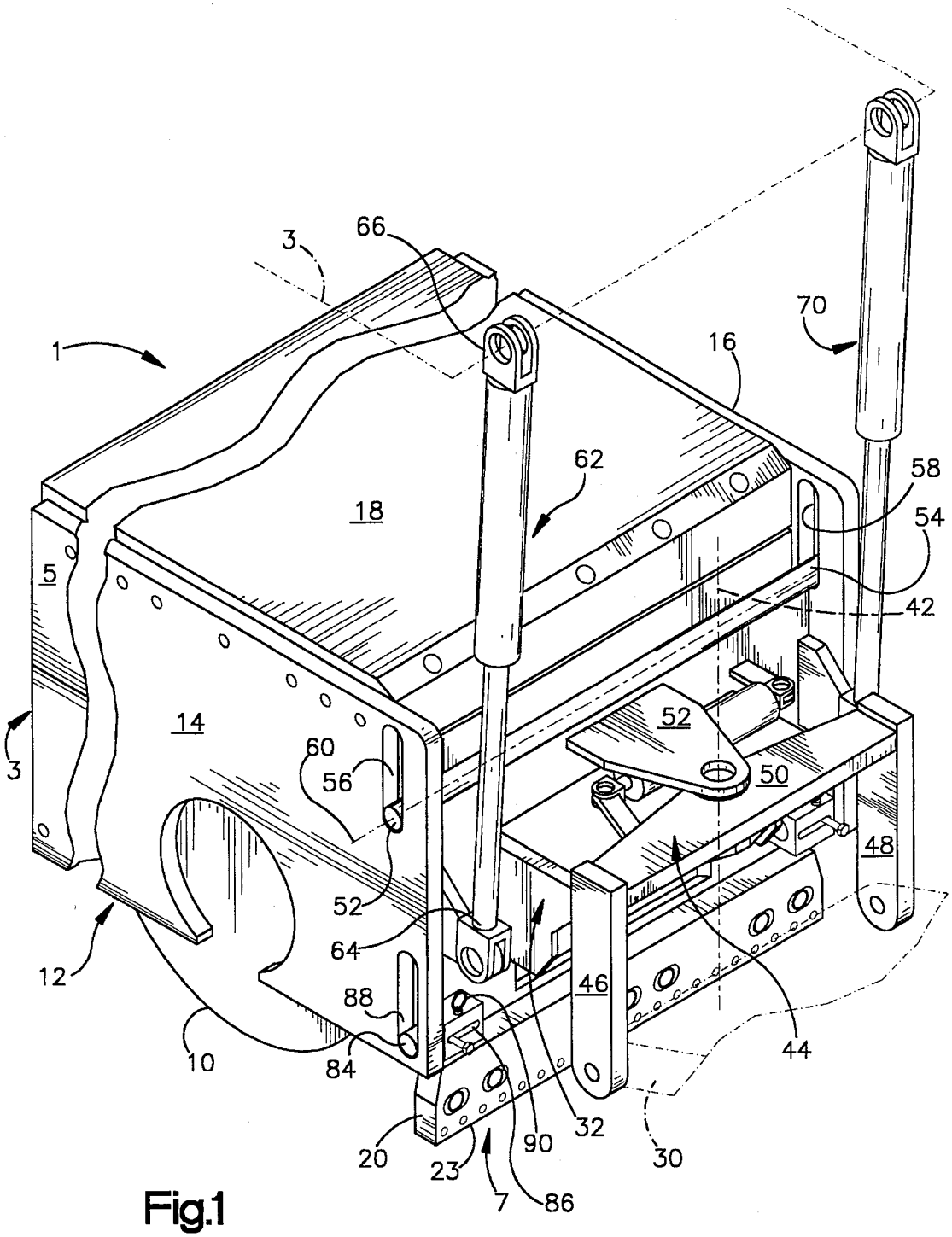
FIG. 1 is a schematic isometric view showing a rear portion of a mobile road milling machine, with parts removed, showing the milling drum, mold board and holder of this invention, with the mold board in the vertical position.

Referring to FIG. 1, there is shown a mobile milling machine 1 having a chassis 3 mounted thereon, the chassis 3 having a front portion 5 and a rear portion 7. As is well known, the machine is provided with a drive motor and steering mechanism (not shown). A milling roller 10 is rotatably mounted transversely on chassis 3 within a roller housing 12. Roller 10 is equipped with cutter teeth (not shown) and is powered for rotation about an axle by any well-known means (not shown). Roller housing 12 is formed by left chassis rail 14 that extends lengthwise along machine 1, right chassis rail 16 that extends parallel to rail 14, top frame member 18 of chassis 3 extending therebetween, and a frontward portion 17 of chassis 3 (FIG. 3). A rearward opening 19 (FIG. 2) in housing 12 is closed by mold board 20. Mold board 20 is mounted transversely of chassis 3 in a substantially vertical position, adjacent roller 12. Mold board comprises a lower edge 23 for contacting a milled road surface 22, an upper edge 24 and an aperture 26 therethrough for directing milled material therethrough.

A loading device 30, preferably a conveyor, is positioned rearwardly of mold board 20, and is carried by chassis mold board 20, as described hereinafter. A holder 32 (FIG. 1) for loading device 30 is fixed to mold board 20. Holder 32 forms an inverted U-shaped platform 34 (FIG. 2) fixed to moldboard 20, as by welding, and extending outwardly therefrom. Holder 32 and mold board 20 form a unitary structure that are fixed in relation to each other. Platform 34 has a pair of vertical side members 36, 38 fixed to mold board 20, and spaced apart from each other, one side member 36 on one lateral side of opening 26 and the other side member on the opposite lateral side of opening 26. Top member 40 is positioned above opening 26 and is fixed to side members 36, 38, extending therebetween.

Loading device 30 is coupled to holder 32 for side-to-side pivoting about a vertical axis 42. The coupling is accomplished by an inverted U-shaped yoke 44 spanning platform 34. Yoke 44 has a pair of downwardly extending arms 46,48 spaced apart from each other, one arm 46 positioned adjacent to vertical side member 36, and the other arm 48 positioned adjacent to the other vertical side member 38. Top arm 50 extends between arms 46,48 and connects them together. Top arm 50 is pivotally connected by any well known means, such as a pivot pin, to top member 40 of holder 32. Yoke 44 is thereby pivotable side-to-side with respect to holder 32, about axis 42. Loading device 30 is pivotally connected to bottom ends of arms 46,48. The loading device 30 can be supported by chassis 3 by well known means, such as cables or a hydraulic cylinder and rod combination, that can be used to raise and lower the angle of loading device 30.

Mold board 20 is equipped with pivot pins 52,54 at the extremity of mold board 20 at top edge 24. One pin 52, extends into vertical slot 56 in left frame rail, and one pin 54 extends into vertical slot 58 in right frame rail 16. Mold board 20 holder 32, and loading device 30 are vertically movable a limited distance (the length of slots 56,58) between a top stop position and a bottom stop position. When pins 52,54 reach the top stop position, vertical movement thereof stops, and the entire combination will pivot outwardly and upwardly, around a horizontal axis 60 through pivot pins 52,54 at top edge 24.

The actuator means for simultaneously raising holder 32, mold board 20 and loading device 30 for the bottom stop position to the top stop position, and for thereafter simultaneously pivoting the entire combination about axis 60 will now be described. First hydraulic cylinder and rod combination 62 has a rod end 64 pivotally connected to mold board 20 adjacent a first lateral side of opening 26, and a cylinder end 66 pivotally connected to chassis 3. Second hydraulic cylinder and rod combination 70 has a rod end 72 pivotally connected to mold board 20 adjacent a second lateral side of opening 26, and a cylinder end 74 pivotally connected to chassis 3. Combinations 62,70 extend upwardly parallel to each. Thus, it can be understood that movement of the rods 64,72 will cause the mold board 20 and members connected thereto to move up and down in slots 56,58 and to pivot about axis 60. In order to restrain the mold board movement to a vertical direction, locking devices 80,82 are positioned on mold board 20 at the lower extremity, adjacent bottom edge 23. A description of one device will suffice because both devices are the same. A locking pin 84 is slidably positioned in a housing 86 fastened to mold board 20. Pin 84 can be extended into an adjacent slot 88 in the adjacent frame rail 14. The pin 84 is locked in place by a removable key 90 that extends through housing 86 and blocks movement of pin 84. With pin 84 in the adjacent slot 88 mold board 20 can only move vertically. Removal of pin 84 from slot 88 permits mold board 20 to pivot outwardly and upwardly.

It should be apparent that, when the mold board 20 is in the operating condition, the combined weight of the loading device 30, the holder 32 and the yoke will cause the mold board 20 to move vertically downward to contact the milled road surface. Too much weight on the mold board 20 will cause the machine to slow down, thereby reducing production. Therefore, the hydraulic actuator circuit of this invention provides a limited upward support force acting through the cylinder and rod combinations 62,70 on the aforesaid combination to permit the mold board 20 to float along the milled road surface in a grazing (barely touching) contact.

Figure 6:
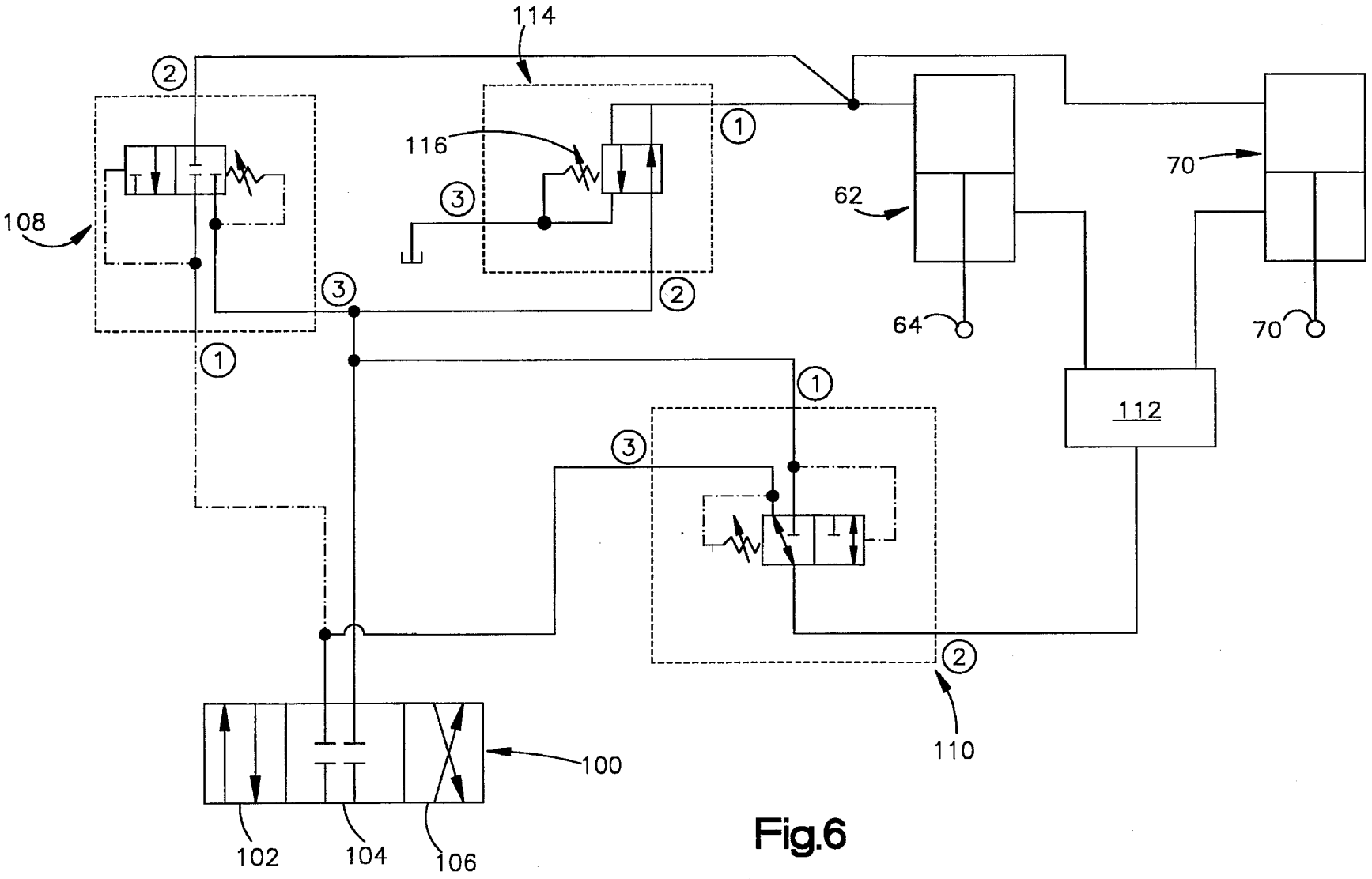
FIG. 6 is an exemplary hydraulic circuit of the invention for actuating the mold board of the invention.

FIG. 6 shows the exemplary hydraulic circuit of this invention. Three position valve 100 has a lifting position 102, a hold position 104 and a float position 106. When the valve 100 is switched into the hold position, three-way pilot valve 110 causes the cylinder/rod combinations 62,70 to be held in their positions. When valve 100 is switched into the lifting position, three-way pilot valve 110 and flow divider 112 permit full pressure to be exerted on the rod end 64,72 of each cylinder 62,70, retracting the rods, to raise the mold board 22. When the valve 100 is switched to the float position, three-way pilot valve 110 and flow divider 112 act as they did in the lift position, but reducing/relief valve 114 permits pressure to be exerted on the back end of the rods 64,70, to partially offset the pressure on the rod ends, thereby causing the mold board 20 to float. The amount of pressure transmitted through valve 114 can be manually adjusted by adjustment knob 116, as is well known. FIG. 6 shows the port designations 1,2,3 for each valve 108,110 and 114.

Figure 5:
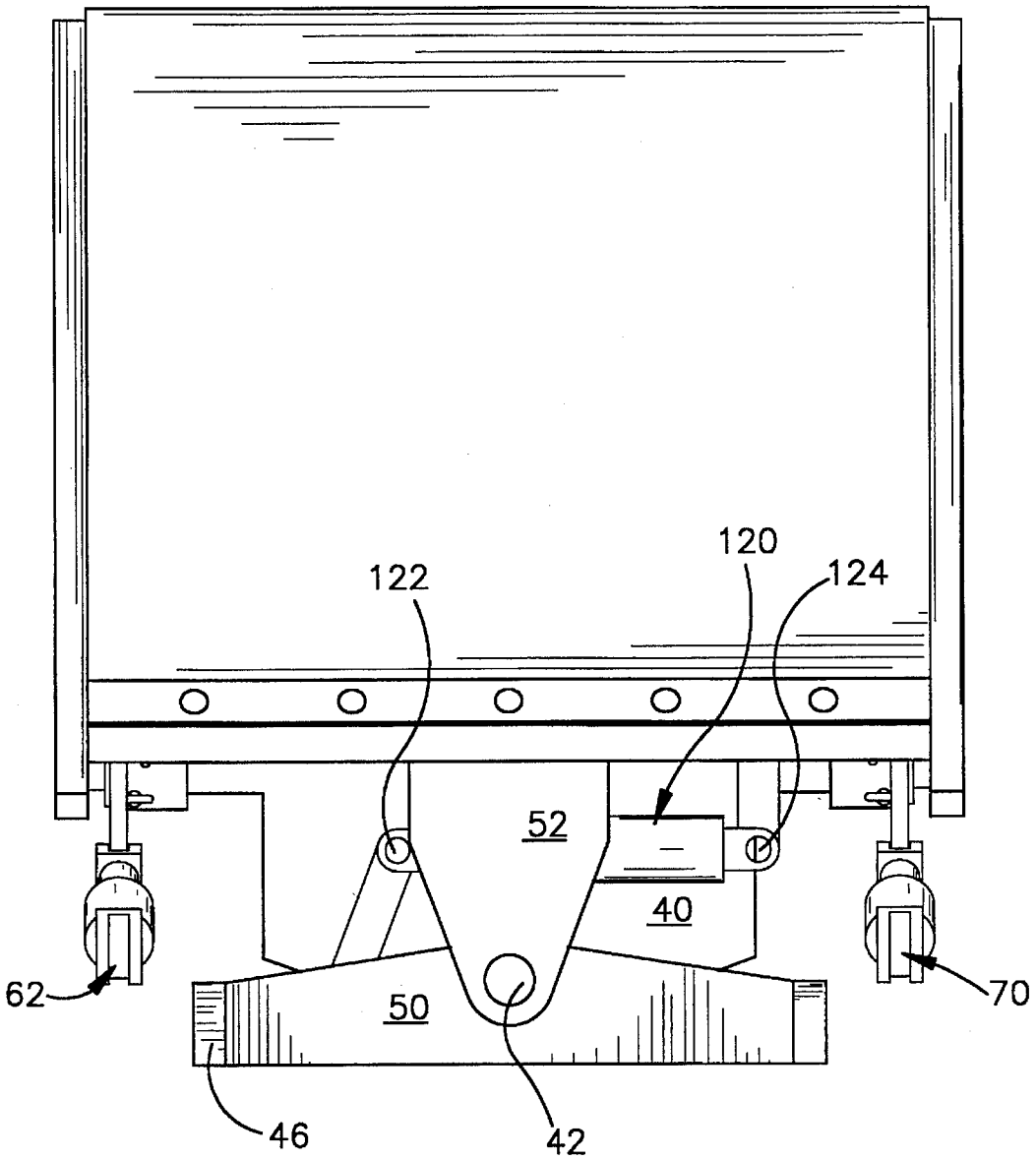
FIG. 5 is a top plan view of FIG. 3.

Now referring to FIG. 5 the means for moving loading member 30 side-to-side about vertical axis 42 will be described. A third hydraulic cylinder and rod combination 120 has a rod end 122 pivotally connected to one yoke arm 46, and cylinder end 124 pivotally connected to mold board 20 adjacent the other yoke arm 48. Extension and retraction of the rod 122 moves the loading device 30 back and forth.

Figure 2:
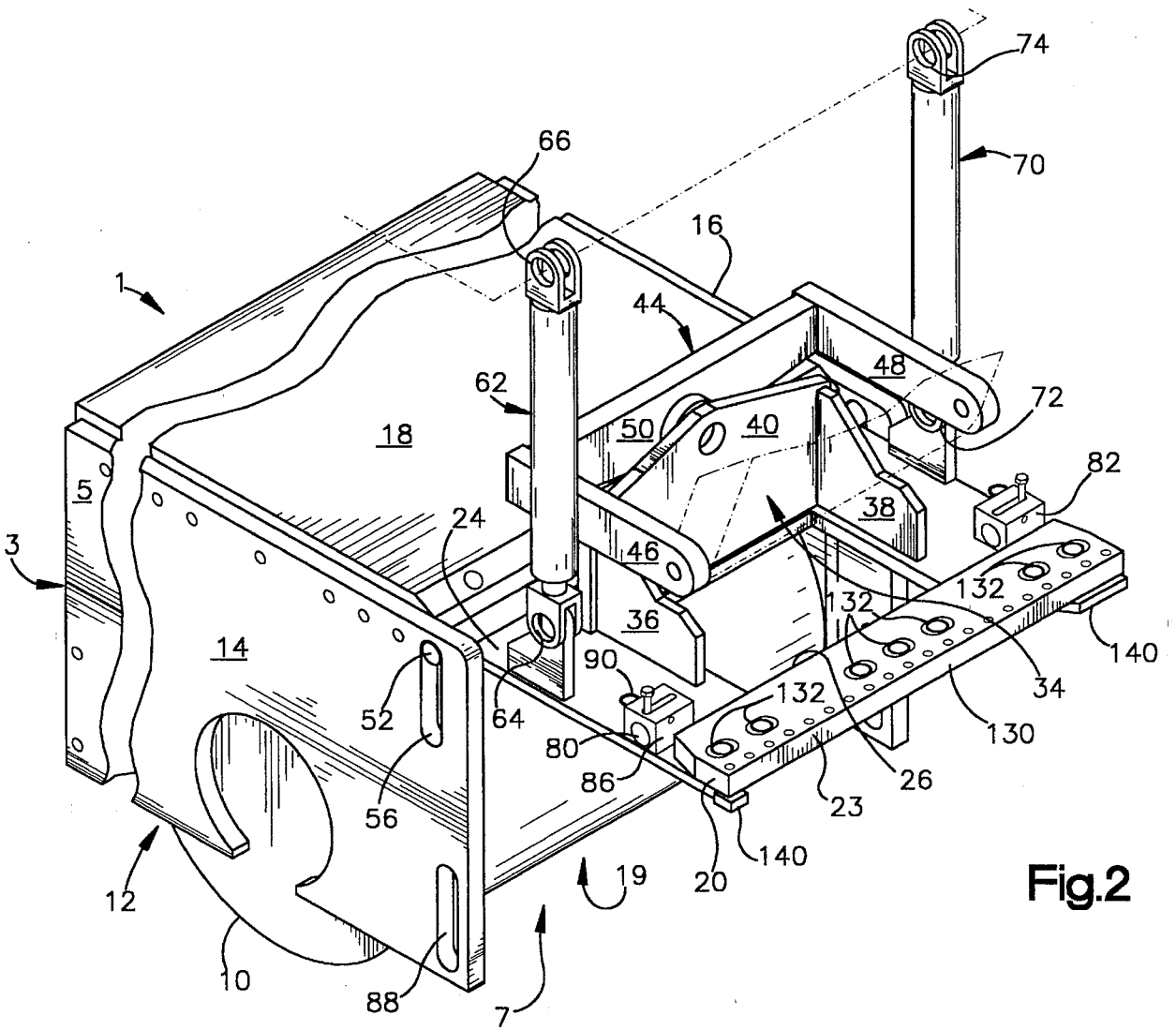
FIG. 2 is a view similar to FIG. 1, with the mold board pivoted upwardly to expose the milling roller.
Figure 3:
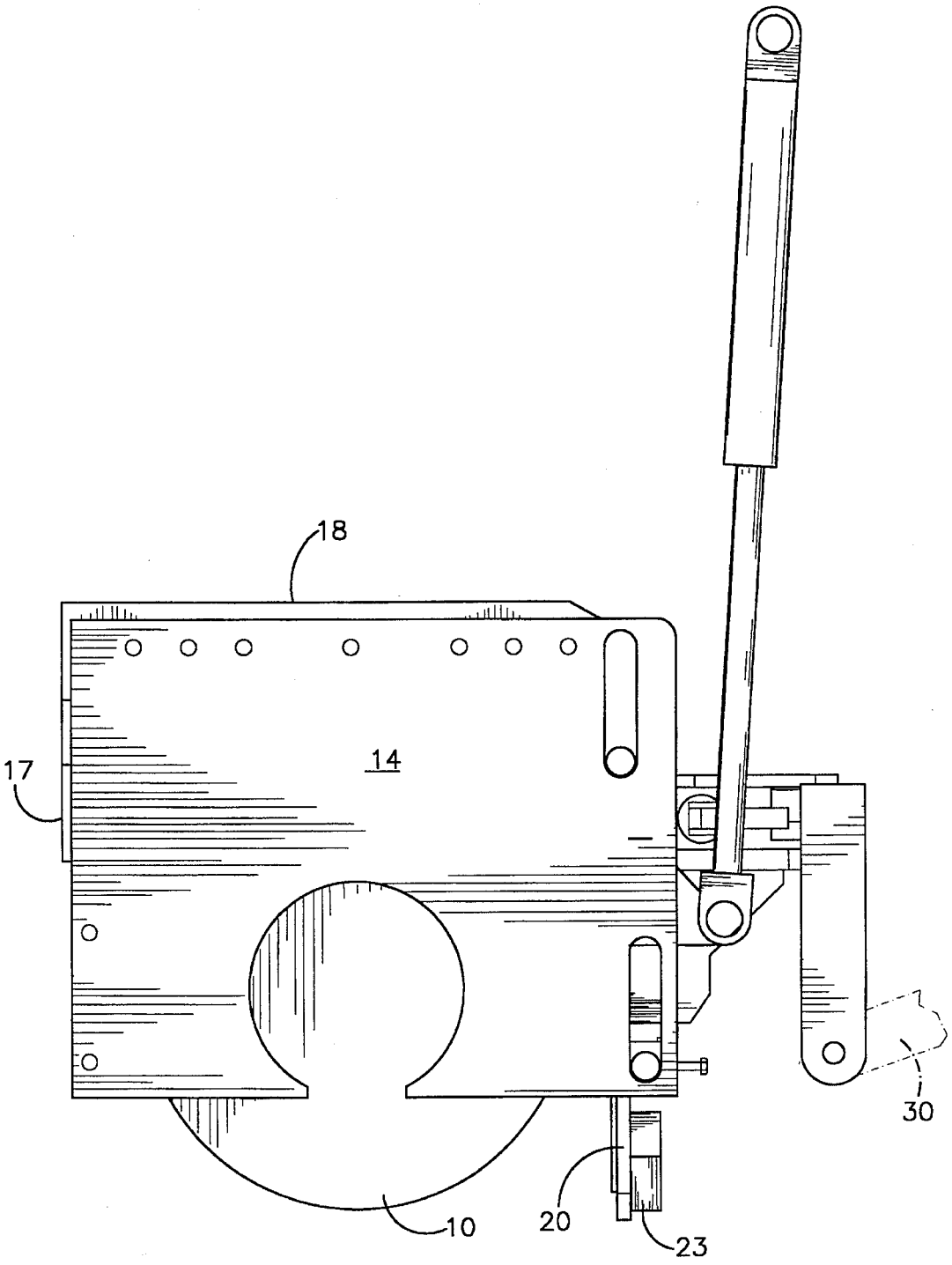
FIG. 3 is a side elevation view, showing the mold board in the vertical position.
Figure 4:
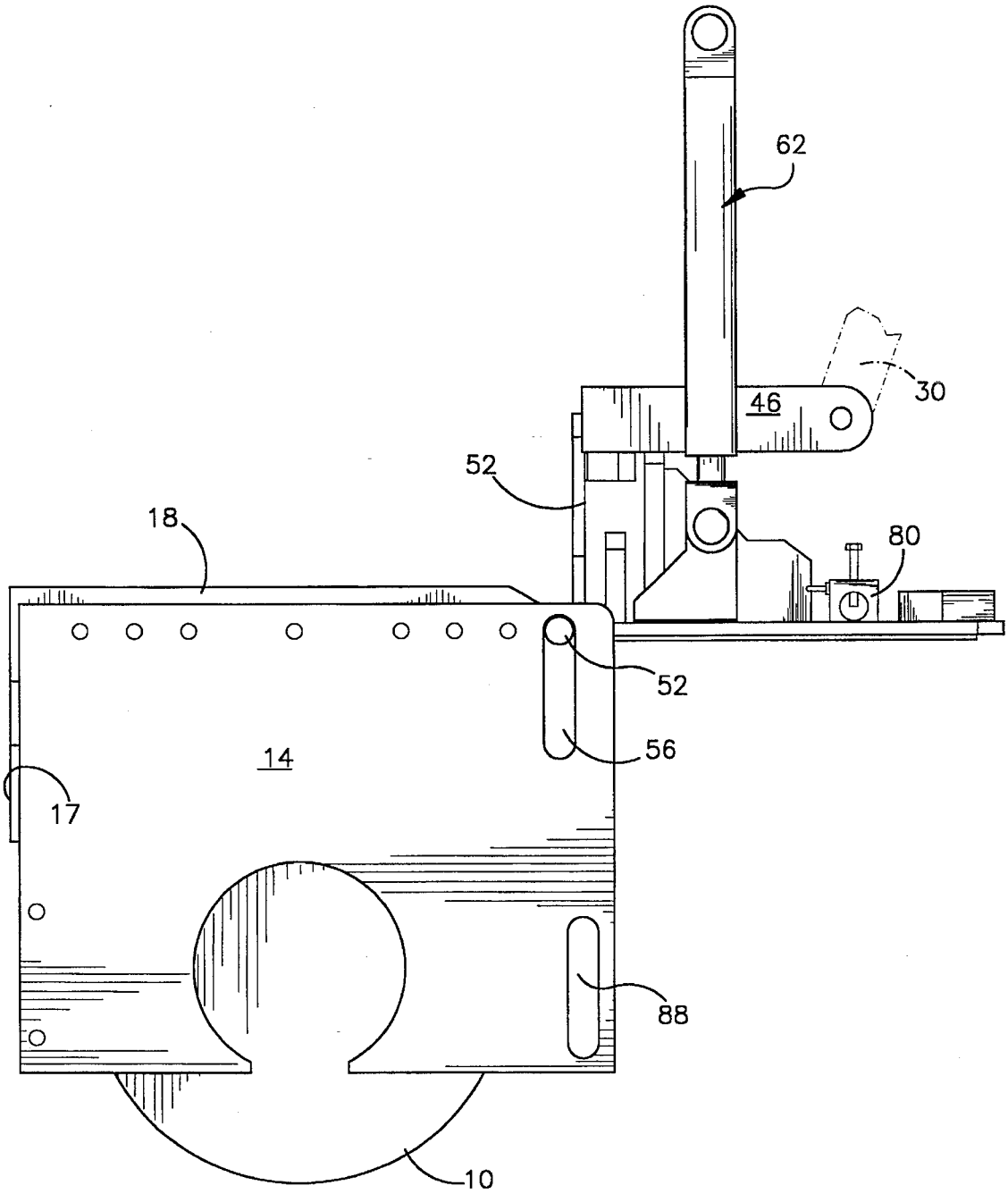
FIG. 4 is a view similar to FIG. 3, showing the mold board pivoted upwardly.

FIG. 2 shows an alternate embodiment for lower edge 23 of mold board 20. Lower edge 23 is formed by a laterally floating support bar 130 that is connected to mold board 20, below opening 26. Support bar 130 is connected, as by bolting, to mold board 20 through laterally elongated slots 132. Slots 132 permit support bar 130 to float laterally, side-to-side, as the machine moves. When the machine moves around a curve in the road, lateral movement of support bar 130 permits the mold board to more accurately track the path of milling cutter 10, thereby improving the collection of milled material. I prefer the laterally floating support bar, but a non-floating support bar will work.

Support bar 130 has a plurality of carbide wear blocks 140 removably connected thereto, along its entire lateral length. Each wear block 140 is connected, as by bolting, to support bar 130 via apertures 142 therethrough. As wear blocks 140 wear out, they can be quickly replaced.

While I prefer hydraulic cylinders, other power systems can work, such as pneumatic actuated cylinders, or electrical linear actuator systems.

Having described the invention, what is claimed is:

1. A mobile milling machine for milling a road surface comprising:

(a) a chassis having a front portion and a rear portion;

(b) a milling roller rotatably mounted transversely on said chassis within a roller housing;

(c) a mold board mounted transversely on said chassis, rearwardly adjacent to said milling roller, in a substantially vertical position, for directing milled material therethrough;

(d) a loading device positioned rearward of said moldboard;

(e) a holder for said loading device fixed to said mold board;

(f) said mold board and said holder being vertically movable a limited distance between a top stop position and a bottom stop position and pivotable at said mold board upper edge about a substantially horizontal axis at said top stop position;

(g) means coupling said holder to said loading device, for pivoting said loading device with respect to said holder about a vertical axis; and (h) actuator means for simultaneously raising said holder, said mold board and said loading device from said bottom stop position to said top stop position, and for thereafter simultaneously pivoting said holder, said mold board and said loading device about said horizontal axis, whereby said roller housing is opened to permit access to said milling roller.

2. A mobile milling machine for milling a road surface comprising:

(a) a chassis having a front portion and a rear portion;

(b) a milling roller rotatably mounted transversely on said chassis within a roller housing;

(c) a mold board mounted transversely on said chassis, in a substantially vertical position, adjacent to said milling roller, said mold board comprising:

(i) a lower edge for contacting a road surface;

(ii) an upper edge; and (iii) an opening therethrough, said opening positioned between said upper and lower edges, for directing milled material therethrough;

(d) a holder, for a loading device, fixed to said mold board;

(e) said mold board and said holder being vertically movable a limited distance between a top stop position and a bottom stop position and pivotable at said mold board upper edge about a substantially horizontal axis at said top stop position;

(f) means coupling said holder to said loading device, for pivoting said loading device with respect to said holder about a vertical axis; and (g) actuator means for simultaneously raising said holder, said mold board and said loading device from said bottom stop position to said top stop position, and for thereafter simultaneously pivoting said holder, said mold board and said loading device about said horizontal axis, whereby said roller housing is opened to permit access to said milling roller.

3. The milling machine of claim 2 wherein, when said mold board is in the operating condition, the combined weight of said holder, said mold board and said loading device cause said mold board to move vertically downward to contact the milled road surface.

4. The milling machine of claim 3 wherein, when said mold board is in the operating condition, said actuator means supplies a limited upward support force to said mold board, said holder and said loading device to permit said mold board to float along the milled road surface in a grazing contact therewith.

5. A mobile milling machine for milling a road surface comprising:

(a) a chassis having a front portion and a rear portion;

(b) a milling roller rotatably mounted transversely on said chassis within a roller housing;

(c) a mold board mounted transversely on said chassis, in a substantially vertical position, adjacent to said milling roller, said mold board comprising:

(i) a lower edge for contacting a road surface;

(ii) an upper edge; and (iii) an opening therethrough, said opening positioned between said upper and lower edges, for directing milled material therethrough;

(d) a holder, for a loading device, fixed to said mold board;

(e) said mold board and said holder being vertically movable a limited distance between a top stop position and a bottom stop position and pivotable at said mold board upper edge about a substantially horizontal axis at said top stop position;

(f) means coupling said holder to said loading device, for pivoting said loading device with respect to said holder about a vertical axis;

(g) actuator means for simultaneously raising said holder, said mold board and said loading device from said bottom stop position to said top stop position, and for thereafter simultaneously pivoting said holder, said mold board and said loading device about said horizontal axis, whereby said roller housing is opened to permit access to said milling roller;

(h) when said mold board is in the operating condition, the combined weight of said holder, said mold board and said loading device cause said mold board to move vertically downward to contact the milled road surface;

(i) when said mold board is in the operating condition, said actuator means supplies a limited upward support force to said mold board, said holder and said loading device to permit said mold board to float along the milled road surface in a grazing contact therewith; and (j) second actuator means for pivoting said loading device with respect to said holder about said vertical axis.

6. The milling machine of claim 5 wherein said holder forms an inverted U-shaped platform fixed to said mold board, extending outwardly therefrom, said platform having a pair of vertical side members spaced apart from each other on opposite sides of said opening and a top member extending therebetween positioned above said opening.

7. The milling machine of claim 6 wherein said means coupling said loading device to said holder comprises an inverted U-shaped yoke spanning said platform, said yoke having a pair of downwardly extending arms spaced apart from each other, each arm positioned adjacent to one of said holder's vertical side members, and a top arm extending therebetween, said top arm pivotally connected at said vertical axis to said holder's top member for pivoting said yoke with respect to said holder about said vertical axis.

8. The milling machine of claim 7 wherein said loading device is pivotally coupled to said yoke at a bottom end of each of said arms.

9. The invention of claim 8 wherein said actuator means comprises:

(a) a first hydraulic cylinder and rod combination, having a rod end pivotally connected to said mold board adjacent a first side of said opening and a cylinder end pivotally connected to said chassis; and (b) a second hydraulic cylinder and rod combination, having a rod end pivotally connected to said mold board adjacent a second side of said opening and a cylinder end pivotally connected to said chassis; and (c) hydraulic circuit means for actuating said first and second hydraulic cylinder and rod combinations.

10. The milling machine of claim 9 wherein said second actuator means comprises:

(a) a third hydraulic cylinder and rod combination, having a rod end pivotally connected to one of said yoke arms and a cylinder end pivotally connected to said mold board adjacent the other of said yoke arms.

11. The milling machine of claim 10 further comprising: locking means for permitting said mold board to move vertically between said top and bottom stop positions, while not permitting said mold board to pivot at said mold board upper edge at said top stop position.

12. The milling machine of claim 11 wherein said mold board lower edge is formed by a laterally floating support bar connected to said mold board.

13. The milling machine of claim 12 wherein said support bar has removably connected thereto a plurality of wear pads, for contacting the road surface.

* * * * *